US007408295B2

(12) United States Patent
Beck et al.

(10) Patent No.: US 7,408,295 B2
(45) Date of Patent: Aug. 5, 2008

(54) MERCURY AMALGAMS FOR ELEVATED TEMPERATURES IN DISCHARGE LAMPS

(75) Inventors: Martin Beck, Augsburg (DE); Sylvia Frenzel, Friedberg (DE); Roland Hoffmann, Augsburg (DE)

(73) Assignee: Patent-Treuhand-Gesellschaft für Elektrische Glühlampen mbH

( * ) Notice: Subject to any disclaimer, the term of this patent is extended or adjusted under 35 U.S.C. 154(b) by 565 days.

(21) Appl. No.: 11/102,820

(22) Filed: Apr. 11, 2005

(65) Prior Publication Data

US 2005/0231095 A1 Oct. 20, 2005

(30) Foreign Application Priority Data

Apr. 14, 2004 (DE) ..... 10 2004 018 105

(51) Int. Cl.
*H01J 1/62* (2006.01)
*H01J 63/04* (2006.01)

(52) U.S. Cl. ..... 313/490; 313/484; 313/637; 313/639

(58) Field of Classification Search ..... 313/484, 313/490, 568, 577, 637, 639
See application file for complete search history.

(56) References Cited

U.S. PATENT DOCUMENTS

| | | | | |
|---|---|---|---|---|
| 4,157,485 | A * | 6/1979 | Wesselink et al. | 313/566 |
| 5,719,465 | A * | 2/1998 | Den Breeijen et al. | 313/490 |
| 5,917,276 | A * | 6/1999 | Traksel et al. | 313/490 |
| 2001/0030506 | A1 * | 10/2001 | Lankhorst et al. | 313/490 |
| 2004/0104665 | A1 * | 6/2004 | Speer et al. | 313/490 |

FOREIGN PATENT DOCUMENTS

JP 63 066840 3/1988

OTHER PUBLICATIONS

Bloem J. et al: "Some New Mercury Alloys For Use In Fluorescent lamps" Journal of the Illuminating Engineering Society, Apr. 1, 1977.

* cited by examiner

*Primary Examiner*—Joseph L. Williams
*Assistant Examiner*—Kevin Quarterman
(74) *Attorney, Agent, or Firm*—Carlo Bessone

(57) ABSTRACT

The present invention relates to mercury amalgams in discharge lamps for use at elevated operating temperatures.

12 Claims, 3 Drawing Sheets

MERCURY AMALGAMS FOR ELEVATED TEMPERATURES IN DISCHARGE LAMPS

TECHNICAL FIELD

The present invention relates to mercury amalgams in discharge lamps, and to discharge lamps comprising such amalgams.

BACKGROUND ART

Discharge lamps with a mercury fraction in the discharge medium have long been known and are the subject of intensive development work. It is known in particular to introduce mercury into the lamp in the form of an amalgam addition. On account of its relatively high vapor pressure at the temperatures which are encountered and on account of the efficiency with which UV is generated in discharge media with a mercury fraction, mercury is especially suitable for these applications and is therefore in widespread use. If mercury is introduced in the form of amalgams, a range of technical criteria need to be taken into account and complied with, in particular the stability and mechanical handling properties and/or consistency of the amalgam, as well as the vapor pressures in the temperature range in question.

DISCLOSURE OF THE INVENTION

The present invention is based on the technical problem of providing mercury amalgams for temperatures during normal operation of a discharge lamp which are higher than in the prior art (known as working amalgams) and also of providing a corresponding discharge lamp itself.

The invention relates to a mercury amalgam for discharge lamps having a mercury fraction and a master alloy, in which the master alloy corresponds to the general formula $$In_{a-e}X_bY_cZ_dR_e$$

where:

X is at least one element selected from the group consisting of Ag, Cu, Sn,

Y is at least one element selected from the group consisting of Pb, Zn,

Z is at least one element selected from the group consisting of Ni, Te,

R comprises additions of Bi, Sb, Ga and standard residues, and where the following apply for a, b, c, d, e: $70\% \leqq a \leqq 98\%$, $b \leqq 25\%$, $c \leqq 25\%$, $d \leqq 20\%$, $e \leqq 15\%$, and where furthermore $2\% \leqq b$. if $c=0\%$, $5\% \leqq b$ if X is Cu, $d \leqq 5\%$ if Z is Ni, and $e \leqq 5\%$ if R is Ga, and to a discharge lamp comprising a mercury amalgam of this type.

Preferred configurations are given in the dependent claims.

The inventors have established that there are certain applications in which, during normal operation of the lamp, a mercury amalgam reaches significantly higher temperatures than is conventionally the case. The temperature range which is of particular interest here is between 100° C. and 170° C. The generally known mercury amalgams are unsuitable for this temperature range. The inventors have discovered that mercury amalgams together with what is known as a master alloy, i.e. the metal mixture or alloy which is to be processed with mercury to form the amalgam, in accordance with the general formula given above and the following conditions, are eminently suitable for the temperature range mentioned.

The invention is based first of all on, maintaining a relatively high In content in the master alloy (with the term alloy in this context being understood in its general sense as a term encompassing a very wide range of types of metal mixtures, but in particular actual alloys). The In content is within the limits given above for the stoichiometric parameter a, i.e. between 70% and 98%. Furthermore preferred upper limits are 97.5% and 97%. Preferred lower limits are 75%, 80%, 85%, 90%, 92%. Here and in the text which follows it is in each case the case that the numerical values given are increasingly preferable in the order given. Furthermore, these limits are always inclusive. Finally, details given in % in the present description and in the claims fundamentally refer to percent by mass.

In this context, it should be noted that the stoichiometry parameter a here still includes additions of in particular Bi, Sb and Ga of up to 15%, in the case of Ga of up to 5%. The actual lower limit for the true In content is therefore 55%.

The Bi, Sb or Ga additions do not significantly interfere with the invention but also do not themselves perform any important function.

The Ag, Cu and/or Sn contents summarized under X have the function of widening the melting range. This is achieved by introducing multiphase states in the master alloy. Particularly preferred in this, context is Ag, and under certain circumstances also combinations with Cu and/or Sn. According to the invention, the corresponding stoichiometry parameter b is at most 25%. The upper limits of 20%, 15%, 12%, 10%, 8% are preferred. If the component Y, which is explained in more detail below, is not present, i.e. c=0%, b should be at least 2%. Furthermore, if Cu is selected for X, b should be at least 5%. Irrespective of this, in any case, the lower limits of 2%, 2.5%, 3% and 3.5% are preferred; b may also be below 2% or 0%, i.e. X can be substantially or completely absent, if component Y referred to below is present.

The component summarized as Y has the function of shifting the upper limit of the melting range toward higher temperatures. It is in this way possible, if desired, in particular to increase the upper limit of a typical usable vapor pressure range up to approx. 4 Pa from the order of magnitude of around 145° C. to 160° C. or 170° C. Pb is preferred over Zn in this context, since Zn can lead to blackening. According to the invention, the corresponding stoichiometry parameter, c is less than 25%. Preferred upper limits are 20%, 18%, 16%, 14%, 12%, 10%. Since in very good master alloys it is even possible to dispense with Y altogether, specifically if there is no need to shift the upper limit of the melting range, the value 0% is particularly preferred according to the invention.

High values of over 20% are of interest at relatively high lamp powers of over 100 W and/or in the case of lamp geometries in which particularly high levels of heat are introduced. One example of a geometry of this type is the helical lamp of the exemplary embodiment. However, constituent Y is optional and not absolutely imperative for the invention.

Z symbolizes a further constituent combining Ni and Te, which, in metallic solution or an intermetallic compound, can create or improve pasty states of the amalgam. The corresponding increase in viscosity may be of relevance to the handling of the amalgam and/or to preventing it from dripping or running out of the intended location in the lamp. Ni or Te are of no real significance to the vapor pressure of the Hg or the amalgam formation. The usefulness of this addition is very much dependent on the way in which the amalgam is introduced into and mounted in the lamp.

Preferred values for stoichiometry parameter d are between 0% and 5% in the case of Ni and between 0% and 20% in the case of Te. In this case too, Z can even be dispensed with altogether in very good master alloys. d=0% is therefore also a value which is preferred in accordance with the invention. If relatively large amounts of Te are provided, the In content should tend to be in the upper range, preferably over 80%, better 85% and even better 90%.

The Hg content itself, which is not considered part of the master alloy, is preferably between 3% and 20%. The lower limit of 3% does not form a significant reserve under normal circumstances, and consequently values of over 7% and better over 10% are preferred. Furthermore, it is preferable for the Hg content to be at most 15%.

These master alloys can be used to produce Hg amalgams which deliver favorable vapor pressures of approximately 0.5-4 Pa in the desired temperature range or part of it, with vapor pressures of between 1 and 2 Pa being preferred. The range from 0.5-0.7 Pa, on the one hand, up to approximately 4 Pa, on the other hand, corresponds to a light yield of at least 90% in many fluorescent lamps. By way of example, in the case of what are known as T8 lamps with a diameter of approximately 26 mm, vapor pressures of the order of magnitude of 1 Pa are expedient, whereas in the case of T5 lamps with diameters of 16 mm 1.6 Pa tends to be preferred. However, there is a tolerance range of approximately 20%, or better 10%. It can approximately be assumed that the lamp diameter in the case of tubular lamps is inversely proportional to the preferred Hg vapor pressure.

BRIEF DESCRIPTION OF THE DRAWINGS

In the text which follows, the invention is explained by way of example with reference to the drawings, in which features disclosed are of relevance both to the process aspect and to the apparatus aspect of the invention and may also be pertinent to the invention in combinations other than those presented.

In detail, in the drawings.

BEST MODE FOR CARRYING OUT THE INVENTION

The following amalgams have proven particularly suitable: as a first exemplary embodiment, a fraction of 10 parts by weight of. Hg with a master alloy comprising 97% by weight of In and 3% by weight of Sn was used, meaning that the master alloy is written as $In_{97}Sn_3$. In this case, Sn was selected as element X, even though Ag is preferred in relative terms. Furthermore, in this embodiment a relatively low value of 3% by weight of Sn was used, even though values of over 3.5% by weight are even more expedient.

A further example contains the master alloy $In_{96}Cu_4$. Here, the stoichiometry parameter for the element X is already in the particularly preferred range. However, in this case Cu was selected for element X.

Furthermore, an amalgam in which the master alloy $In_{88}Pb_{12}$ was used was tested and found to be suitable. The Pb content is relatively high and no longer in the particularly preferred range. However, the Pb content meant that it was possible to dispense with the addition of element X altogether.

A further example which has been used in the helical lamp described in more detail below has a lower Pb content of 10% by weight, i.e. comprises a master alloy $In_{90}Pb_{10}$. Here, however, a ratio of 3% by weight of Hg to 97% by weight of master alloy was used.

A second amalgam used with the helical lamp explained below uses the master alloy $In_{96}Ag_4$ (with 10% by weight of Hg), i.e. makes do without element Y and selects the element Ag, which is actually the most preferred embodiment, for X.

Further examples include master alloys $In_{84}Ag_6Pb_{10}$ and $In_{84}Ag_7Pb_9$.

To increase the viscosity, Ni or Te may in each case be added to the latter master alloys, specifically, by way of example, as follows:

$In_{80}Ag_6Pb_{10}Ni_4$, $In_{81}Ag_7Pb_9Ni_3$, $In_{72}Ag_6Pb_{10}Te_{12}$, $In_{70}Ag_7Pb_9Te_{14}$.

Additions of the element R do not bring any technical benefit and are therefore not used in preferred master alloys.

Moreover, the following text provides an exemplary embodiment of a lamp in which, by way of example, there is a need for amalgams for using higher temperature ranges.

Figure 1A:
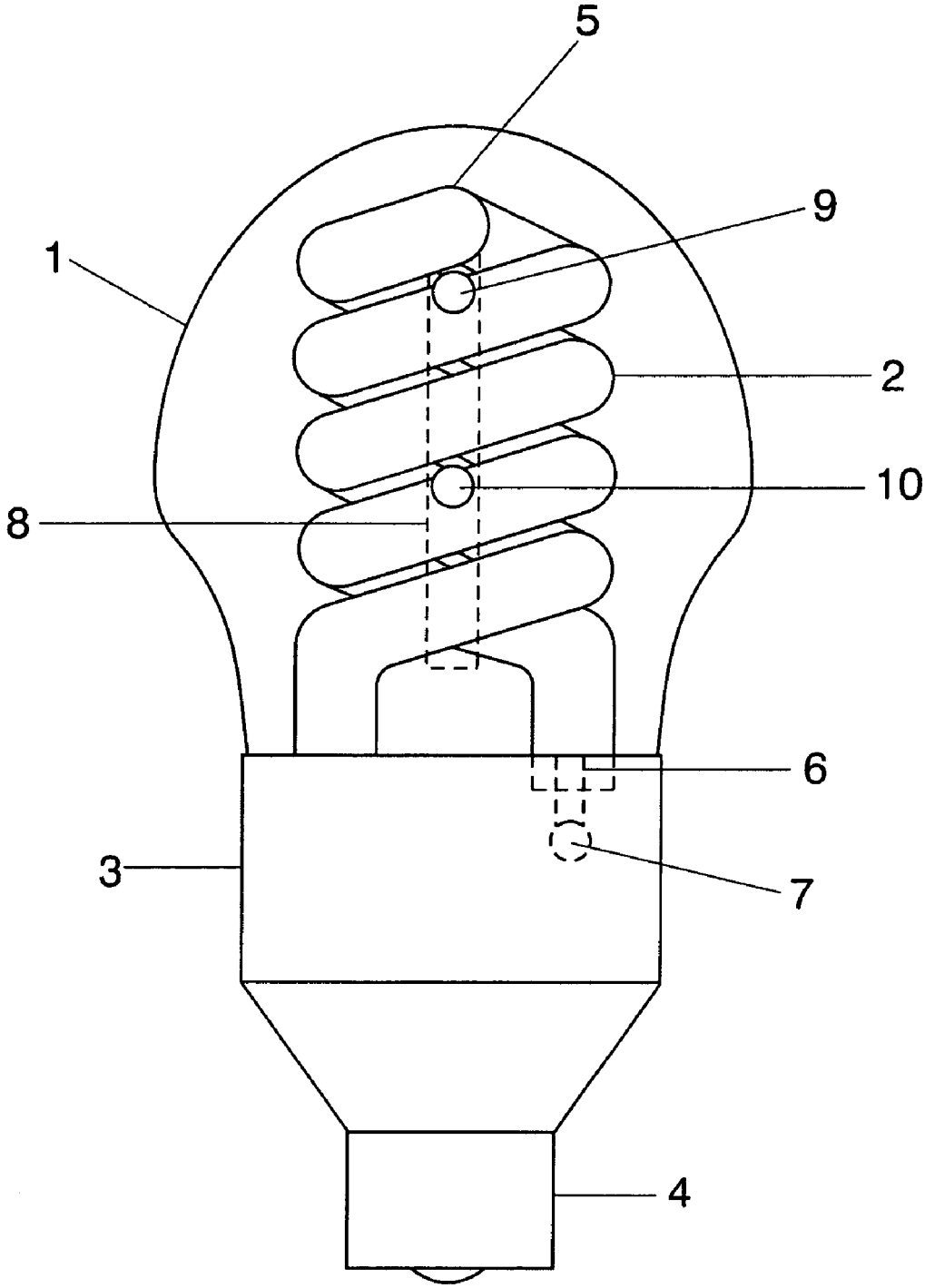
FIG. 1*a* shows a diagrammatic outline illustration of a compact fluorescent lamp clearly illustrating a first possible application of the invention as distinct from the prior art.

FIG. 1*a* shows an outline illustration of a compact fluorescent lamp, on the basis of which both the prior art and the invention are to be explained. The lamp has an outer bulb 1, which encloses a helically wound discharge tube 2. The discharge tube 2 is connected to an electronic ballast 3, only the housing of which is illustrated; the outer bulb 1 is also secured to this housing. On the opposite side from the outer bulb 1, the housing of the ballast 3 ends at a standardized lamp cap 4. To the extent that it has been described thus far, the lamp shown in FIG. 1*a* is conventional. The same also applies to the shape of the discharge tube 2, which has already been referred to above as a double helix and is wound in two discharge tube parts with two ends starting from the ballast to form a double helix with an alternating sequence of the helix turns of the two discharge tube parts. In an upper region, the two discharge tube parts merge into one another at a location denoted by 5.

FIG. 1*a* illustrates how compact fluorescent lamps of this type, despite having compact external dimensions and a shape very similar to that of conventional incandescent lamps, overall provide a relatively long discharge length.

Reference numeral 6 indicates a conventional exhaust tube fitting at one of the two discharge tube ends, the circle outlined by 7 being intended to illustrate that an Hg source which controls the vapor pressure, for example a ball of amalgam, may be provided here. Further details with which the person skilled in the art will in any case be familiar, such as the electrodes, fused plate seals or pinches, are not illustrated in more detail in this figure. However, FIG. 1*a* does illustrate that the exhaust tube fitting 6 conventionally has a significantly smaller diameter than the discharge tube 2. In fact, it also has to leave space for the electrodes, which is not shown here. Moreover, the exhaust tube fitting 6 projects into the discharge tube end on one side and on the other side projects from the discharge tube end into the ballast, so that a certain additional length is required both on the part of the discharge tube and on the part of the ballast (in the vertical direction as seen in FIG. 1*a*). In particular, the electrodes have to project beyond that part of the exhaust tube fitting 6 which projects into the discharge tube. In the prior art, they are often stabilized by an additional glass bead.

Finally, it will be clear that the temperature of the Hg source 7 accommodated in the exhaust tube fitting 6 is highly dependent on the ambient temperature in the ballast housing, which in turn is dependent on the external ambient temperature, the operating time and also the installation position of the lamp.

The line which is shown in dashed lines and is designated by 8 illustrates a tube piece according to the invention, which is fitted to the discharge tube 2 in the region of the connection 5 between the two discharge tube parts and extends axially and straight downward from this uppermost, axial position with respect to the helix. In this case, it substantially takes up the axial length of the helix shape.

Positions 9 and 10, which are each marked by a circle, illustrate two possible examples of the arrangement of an Hg source which controls the vapor pressure in the tube piece 8 according to the invention. One position 9 is located slightly below the connection 5 of the discharge tube parts, i.e. already within the interior of the helix, but in the upper region thereof. The other position 10 is located approximately in the center of the helix, as seen in the axial direction (with the helix extending from the lower bend of the discharge tube parts up to the connecting position 5). At both positions, but in particular at the preferred position 10, the temperature of an Hg source in the helix is substantially determined by the radiation originating from the discharge tube 2, since it is to a certain extent enclosed by the helical discharge tube 2. This approximately equates to a radiating cylinder jacket.

With respect to the axial length of the helix, the position 9 should be at a good 20% and position 10 at a good 50%. Both positions show the advantage of rapidly reaching the final temperature after the cold lamp has been switched on. Both positions are significantly less sensitive to fluctuations in the ambient temperature and changes in the installation position compared to the prior art. However, position 10 is even less dependent on the orientation of the lamp in operation, i.e. on the question of whether the discharge tube 2 is arranged at the top, the side or the bottom with respect to the ballast 3 in operation, and on the different convection conditions which result.

It can also be seen from FIG. 1*a* that the exhaust tube function can likewise be performed by the tube piece 8 according to the invention, specifically via its lower end as seen in FIG. 1*a*. It not only provides a large exhaust cross section, since it is not fitted into the discharge tube 2 and does not have to take account of electrodes and other parts, but also it is readily accessible. Finally, the tube piece 8 according to the invention, if desired, can also be used in combination with conventional exhaust tubes 6 for purging operations and the like, and can moreover (independently of conventional exhaust tubes 6) serve as a holder, for example if fused plate seals or pinches are arranged at the lower ends of the discharge tube 2.

Figure 1B:
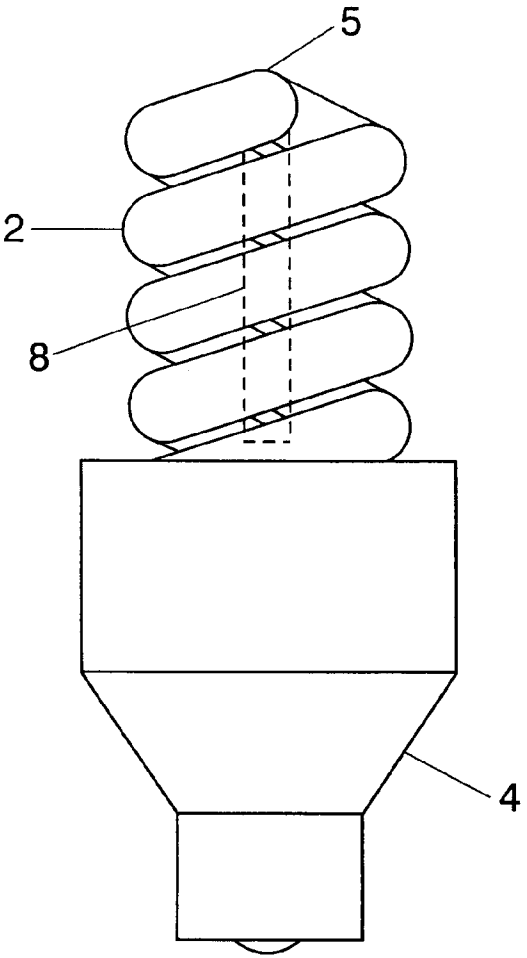
FIG. 1*b* shows a variant to FIG. 1*a,*

FIG. 1*b* shows a variant of FIG. 1*a*, with the same reference numerals used for corresponding parts of the lamp, although not all the details are shown. Unlike in FIG. 1*a*, this is a lamp without an outer bulb and in which, moreover, the discharge tube ends in the double helix shape run into the cap 4. For comparison purposes, reference is made to FIG. 2*b*, which is described below. It will be clearly apparent that the lamp shown in FIG. 1*b* is of particularly compact structure.

Figure 2B:
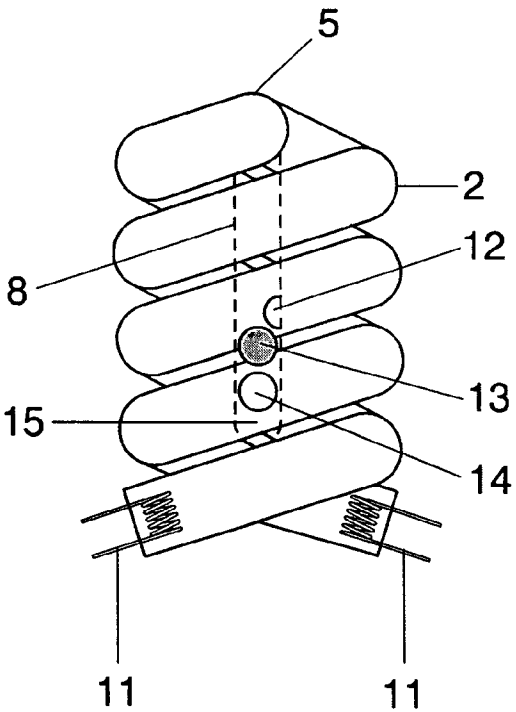
FIG. 2*b* shows a variant of FIG. 2*a,* corresponding to FIG. 1*b,*
Figure 2A:
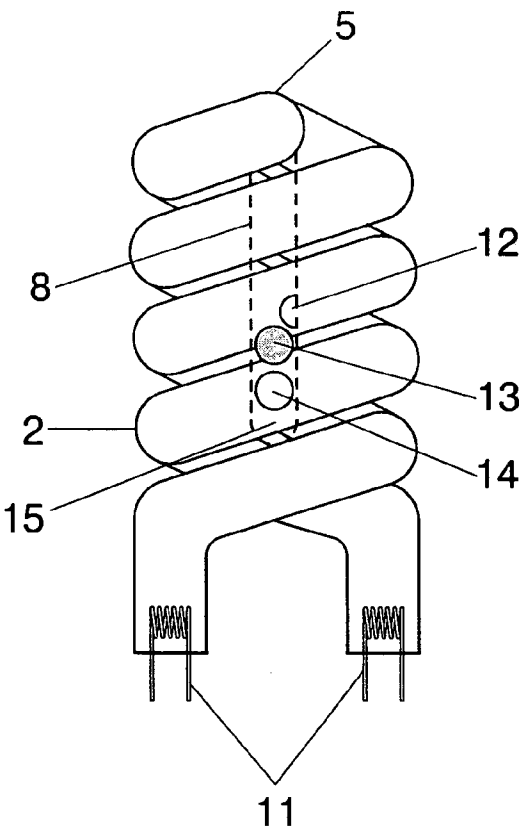
FIG. 2*a* shows a diagrammatic outline illustration of a discharge tube and tube piece according to the invention forming a compact fluorescent lamp as shown in FIG. 1*a,*

FIG. 2*a* shows a discharge tube 2 corresponding to FIG. 1*a*, with a tube piece 8 which is similar to FIG. 1*a* and once again runs axially through the interior of the helix shape. In addition, FIG. 2*a* diagrammatically depicts electrodes 11 at the discharge tube ends. However, the outer bulb 1, the ballast 3 and the cap 4 are not included in the drawing.

In this case, the tube piece 8 does not extend over the entire length of the helix, but rather only over approximately ¾ thereof. It includes a fused glass seal 12, which serves to prevent a retaining body in the form of an iron pill 13 from dropping into the discharge tube 2. The iron pill 13 in turn, on account of surface tension effects and because it blocks a large part of the cross section of the tube piece 8, prevents an amalgam ball 14 from dropping into the discharge tube 2. The amalgam ball 14 as the Hg source is in this example located approximately between 60 and 70% along the axial length of the helix (as measured from the top). The use of the iron pill 13 as a retaining body in particular enables the fused seal 12 to be configured in such a way that before the iron pill 13 and the amalgam ball 14 are put in place, it provides a good exhaust cross section through the tube piece 8 if the latter is used as an exhaust tube. This is because the iron pill 13 and the amalgam ball 14 are only introduced after all the process steps of purging, exhaust pumping, forming, etc. have concluded. After it has been used as an exhaust tube, the tube piece 8 is closed off at its lower end by being fused together, as is intended to be indicated by the shape of the end designated by 15. Before it is closed off, the iron pill 13 and amalgam ball 14 have been inserted and then trapped in the space between the closure 15 and the fused seal 12. The statements which have been made in connection with position 10 in FIG. 1*a* also apply to the positioning of the amalgam ball. In the region of the amalgam ball 14, the tube piece 8 has an IR-absorbing outer coating (not shown).

FIG. 2*b* shows a variant of FIG. 2*a*, corresponding to the lamp shown in FIG. 1*b*, with the same reference numerals used once again.

Ultimately, depending on the lamp power, operating temperatures of the amalgam ball 14 of over 100° C., i.e. well above the range which is usual, are reached. These temperatures may even rise to the range of 160-170° C. A discharge lamp of this type can be operated without problems using the alloys according to the invention.

The following text gives a description of a further exemplary embodiment for a lamp which requires working amalgams for relatively high temperature ranges.

Figure 3:
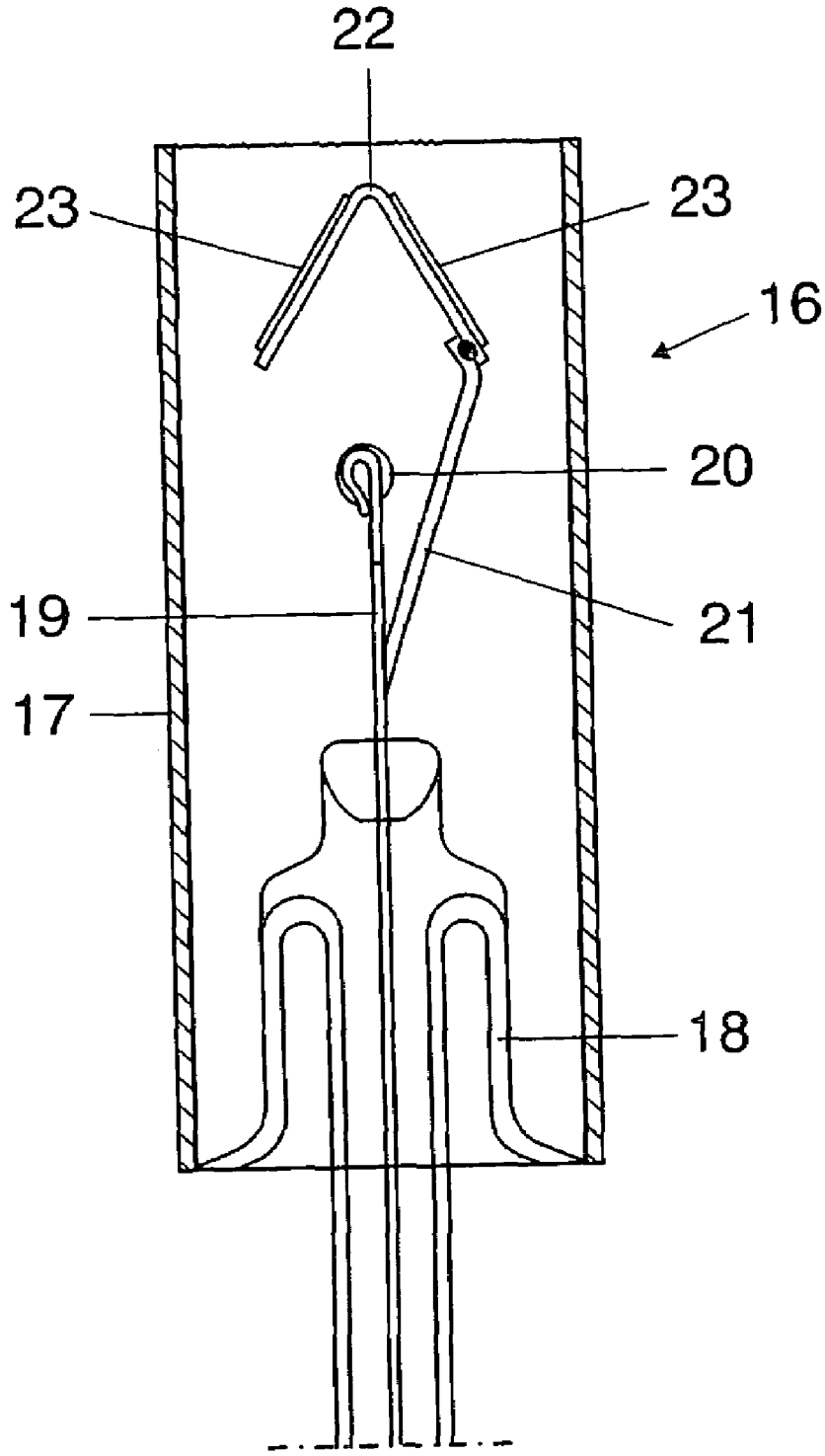
FIG. 3 shows a diagrammatic outline illustration of an end portion of a straight tubular fluorescent lamp to provide a clear illustration of a further possible application of the invention distinct from the prior art.

FIG. 3 shows an outline illustration of an end of a straight tubular fluorescent lamp 16 without a cap. The free end of the tubular vessel 17 of the fluorescent lamp 16 is closed off by a fused plate seal 18, with supply conductors 19 pinched into it. At their inner end, the supply conductors bear a filament 20. A wire 21 is soldered to a supply conductor 19 between the fused plate seal 18 and the filament 20, and this wire 21, at its free end, bears a metal sheet 22 angled off in a roof shape. The wire is bent in such a way that the metal sheet 22 is arranged in front of the filament 20, as seen in the discharge direction.

A master alloy 23 consisting of 96% of In and 4% of Ag has been applied to the metal sheet. During filling, sufficient Hg is added to the lamp for the Hg concentration of the mercury amalgam composed of master alloy and mercury fraction in this type of straight, tubular fluorescent lamp to be 12% at the start of initial lamp operation. Consumption of Hg reduces the Hg concentration to 3% over the service life of the lamp.

What is claimed is:

1. A mercury amalgam for discharge lamps having a mercury fraction and a master alloy, in which the master alloy corresponds to the general formula $$In_{a-e}X_bY_cZ_dR_e$$

where:

X is at least one element selected from the group consisting of Ag, Cu, Sn,

Y is at least one element selected from the group consisting of Pb, Zn,

Z is at least one element selected from the group consisting of Ni, Te,

R comprises additions of Bi, Sb, Ga and standard residues, and where the following apply for a, b, c, d, e:

$70\% \leqq a \leqq 98\%$;

$b \leqq 25\%$;

$c \leqq 25\%$;

$d \leqq 20\%$;

$e \leqq 15\%$.

2. The amalgam as claimed in claim 1, in which X is Ag.

3. The amalgam as claimed in claim 1, in which Y is Pb.

4. The amalgam as claimed in claim 1, in which a is $\geqq 75\%$.

5. The amalgam as claimed in claim 1, in which a is $\leqq 97.5\%$.

6. The amalgam as claimed in claim 1, in which b is $\geqq 2\%$.

7. The amalgam as claimed in claim 1, in which b is $\leqq 20\%$.

8. The amalgam as claimed in claim 1, in which c is $\leqq 20\%$.

9. The amalgam as claimed in claim 1, in which the Hg content in the amalgam is $\geqq 3\%$.

10. A discharge lamp comprising the mercury amalgam as claimed in claim 1, which is designed in such a way that in normal operation the mercury amalgam reaches a temperature of 100° C.-170° C.

11. The discharge lamp as claimed in claim 10, which is designed in such a way that in normal operation a mercury vapor pressure of at least 0.5 Pa.

12. The amalgam as claimed in claim 2, in which Y is Pb.

* * * * *